United States Patent [19]

Theros

[11] Patent Number: 4,872,551

[45] Date of Patent: Oct. 10, 1989

[54] WORKING CLAMSHELL BLISTER PACKAGE FOR PLIERS OR SIMILAR HAND TOOLS

[75] Inventor: Brian S. Theros, Lemont, Ill.

[73] Assignee: Klein Tools Corporation, Chicago, Ill.

[21] Appl. No.: 320,501

[22] Filed: Mar. 8, 1989

[51] Int. Cl.[4] ..... B65D 73/00

[52] U.S. Cl. ..... 206/349; 206/470; 206/471

[58] Field of Search ..... 206/349, 470, 461, 471, 206/462, 463

[56] References Cited

U.S. PATENT DOCUMENTS

| | | | |
|---|---|---|---|
| 3,127,993 | 4/1964 | Phipps | 206/462 X |
| 3,516,585 | 6/1970 | Inwood | 206/349 X |
| 3,857,487 | 12/1974 | Misslin | 206/463 |
| 4,019,632 | 4/1977 | Greenlee | 206/349 |
| 4,165,805 | 8/1979 | Fethke et al. | 206/349 |
| 4,423,811 | 1/1984 | Knapp | 206/470 X |
| 4,512,474 | 4/1985 | Harding | 206/461 |
| 4,610,354 | 9/1986 | Hostetler | 206/349 |
| 4,650,074 | 3/1987 | Vosbikian | 206/349 |
| 4,714,159 | 12/1987 | Linden | 206/349 |

FOREIGN PATENT DOCUMENTS

| | | | |
|---|---|---|---|
| 2435010 | 2/1976 | Fed. Rep. of Germany | 206/349 |
| 2444606 | 4/1976 | Fed. Rep. of Germany | 206/349 |
| 2509491 | 9/1976 | Fed. Rep. of Germany | 206/349 |
| 2922505 | 12/1979 | Fed. Rep. of Germany | 206/462 |
| 1242088 | 8/1971 | United Kingdom | 206/461 |

*Primary Examiner*—William Price

*Attorney, Agent, or Firm*—Welsh & Katz Ltd.

[57] ABSTRACT

A working clamshell blister package for a pliers or similar tool includes a pair of opposing mirror-image panels having recesses and joined along a common lower end to form a base portion. The base portion is provided with a pair of openings for accomodating the handles of the pliers and has a bridge formation located between the openings. When the opposing panels are placed in contacting relation, a compartment is formed in which the working portion of the pliers may be enclosed, with the junction of the pliers members being supported by the bridge formation. A pair of pliers contained in the package may be manipulated a specified extent by the customer prior to purchase without opening the package.

16 Claims, 2 Drawing Sheets

WORKING CLAMSHELL BLISTER PACKAGE FOR PLIERS OR SIMILAR HAND TOOLS

BACKGROUND OF THE INVENTION

The present invention relates to clamshell type blister packages, and specifically relates to such a package used to display pliers or similar hand tools in a manner which permits manipulation thereof by the prospective purchaser at the point of sale.

Hand tools which operate with a scissors type pivoting action such as pliers, wire cutters, wire strippers, etc. are often sold mounted on a display card bearing the name of maker, distributor, and/or marketer and other advertising material. The tool is fastened to the card in some manner such as by staples or wire loops or clips. An alternative method of displaying such hand tools is to enclose them in a clear plastic printed bag or in a transparent plastic blister and card package which envelopes the tool and is provided with eyelets for placing the package of the hooks of a display rack. Bags are not as aesthetically pleasing to merchandisers as are other conventional packages.

Blister packages have been known for some time, and it is quite customary to find hand tools enclosed within a formed blister made of transparent, stiff, flexible material such as polyvinyl chloride (PVC) and applied to a card by heat and/or adhesive means. These known blisters completely enclose the article of merchandise, and it is impossible for the purchaser to touch or test the article without destroying the blister.

U.S. Pat. No. 4,165,805 discloses a blister and card type package for a scissors or pliers in which the blister is generally shaped to conform to the shape of the tool. One end of the generally elongated transparent covering is shaped to closely embrace and lock in place one extremity of the tool, with the other end of the blister being splayed to permit restricted movement of the blade or sharpened edge of the tool. A cut-out portion in the blister permits the tool to be grasped and tested by a prospective purchaser. Conventional blister and card packages of this type do not permit total visibility of the packaged article, in that the card obstructs one side thereof.

U.S. Pat. No. 4,423,811 discloses a molded trifold blister type package which permits substantial visibility of a non-moving packaged article, i.e., a paintbrush, while also providing an opening through which a portion of the packaged article may extend for manipulation by a prospective purchaser. One disadvantage of the disclosed tri-fold package is the lack of adequate support formations of articles such as pliers or scissors or other hand tools having movable handles.

A further disadvantage of conventional form-fitting blister packages is that pliers and other tools packaged therein are provided with lubricated rivet or pivot areas which often experience lubricant seeping from the tool and contacting the interior surface of the transparent plastic package, thus causing an unsightly condition.

Thus, there is a need for a transparent package for pliers, scissors or other hand tools having pivotal or moving members which permits at least a restricted amount of manipulation of the handles and operation of the device prior to purchase, while maintaining the package intact. There is also a need for such a package which is inexpensive to produce and assemble, which provides visibility of all sides of the packaged article and which is not subject to contamination by lubricant seeping from a packaged tool.

SUMMARY OF THE INVENTION

Accordingly, a working clamshell type blister package for holding and displaying pliers and similar hand tools is disclosed which encloses the upper portion of the tool while allowing the handles to extend through a lower end thereof, and is configured to enable a prospective customer to manipulate the handles a specified amount to provide an adequate indication of the operational characteristics of the tool. The tool is substantially visible on all sides through the package, which may be suspended from a point of purchase display.

More specifically, the package includes first and second opposing mirror image panels, each having an upper end, a lower end and a recess formation, portions of the lower ends of the panels being integrally joined to form a hinged base portion, and the base portion having a pair of openings with a bridge formation disposed therebetween. The panels are configured so that when placed in contacting relationship to each other, a compartment is formed by the recesses for enclosing the upper portion of the tool. The compartment is somewhat splayed in shape to accommodate at least restricted pivoting action of the upper enclosed portion of the tool. The bridge formation is configured to withstand compressive deformation due to the squeezing manipulaion of the pliers, while retaining its tool support characteristics. In addition, each panel may be provided with a dome or bubble-like formation in the recess area which is situated adjacent the pivot area of the pliers to prevent lubricant seeping from the pliers from coming in contact with the package.

DESCRIPTION OF THE PREFERRED EMBODIMENT

Figure 1:
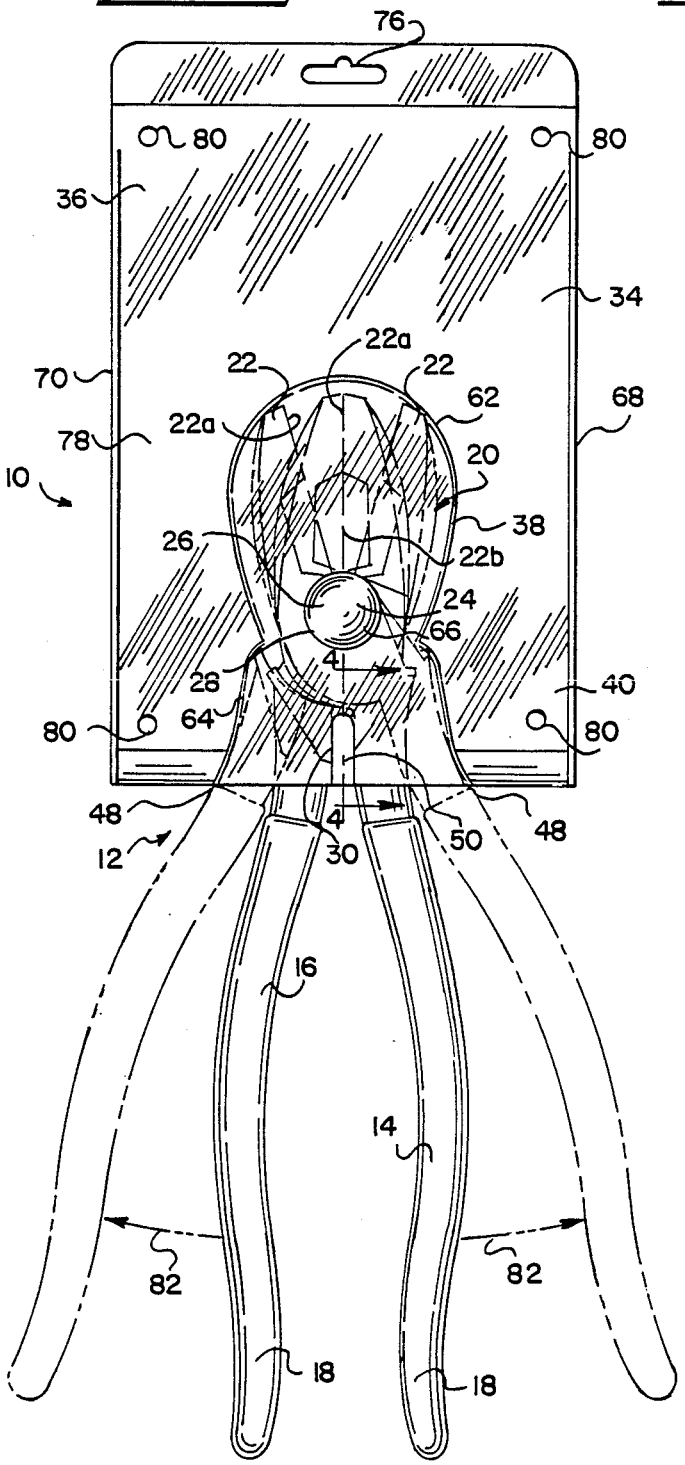
FIG. 1 is a front view of the package of the invention showing a pliers enclosed therein.
Figure 2:
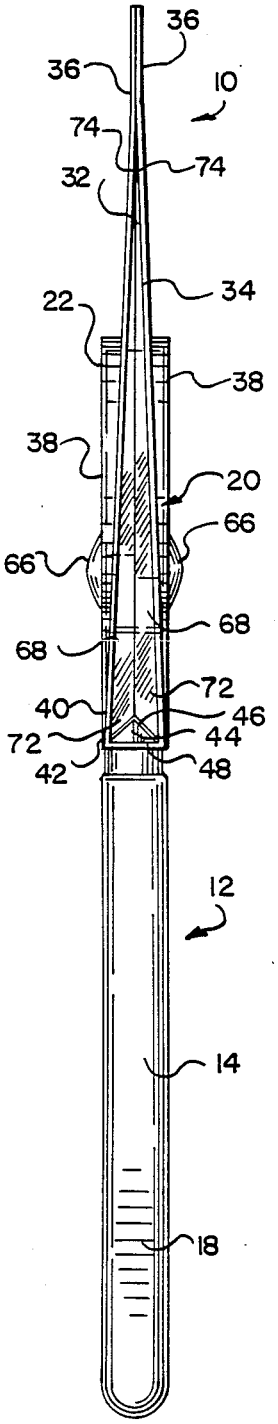
FIG. 2 is a side elevational view of the package illustrated in FIG. 1.

Referring now to FIGS. 1 and 2, the working clamshell blister package of the invention is indicated generally at 10 and is shown enclosing a pliers 12 which includes a pair of plier half members 14 and 16, each such half member having a handle end 18 and a head or working end 20 having at least one jaw formation 22. In the preferred embodiment, the pliers 12 are depicted as a linesman's pliers, having a gripping jaw portion **22*a* and a cutting jaw portion 22*b*. However, other types of pliers or similar type pivoting tools are contemplated. The plier halves 14 and 16 are joined at a junction or pivot point 24 which, in the preferred embodiment, is a rivet 26 integral with the member 14 and which projects through an opening 28 in the member 16. During fabrication, the free end of the rivet 26 is machined down to be flush with the surface of the member 16. The pliers 12 is configured so that a junction of the handles 18 and the rivet portion or pivot point 24 forms a crotch 30**.

Figures 3, 4, 5, 6, 7:
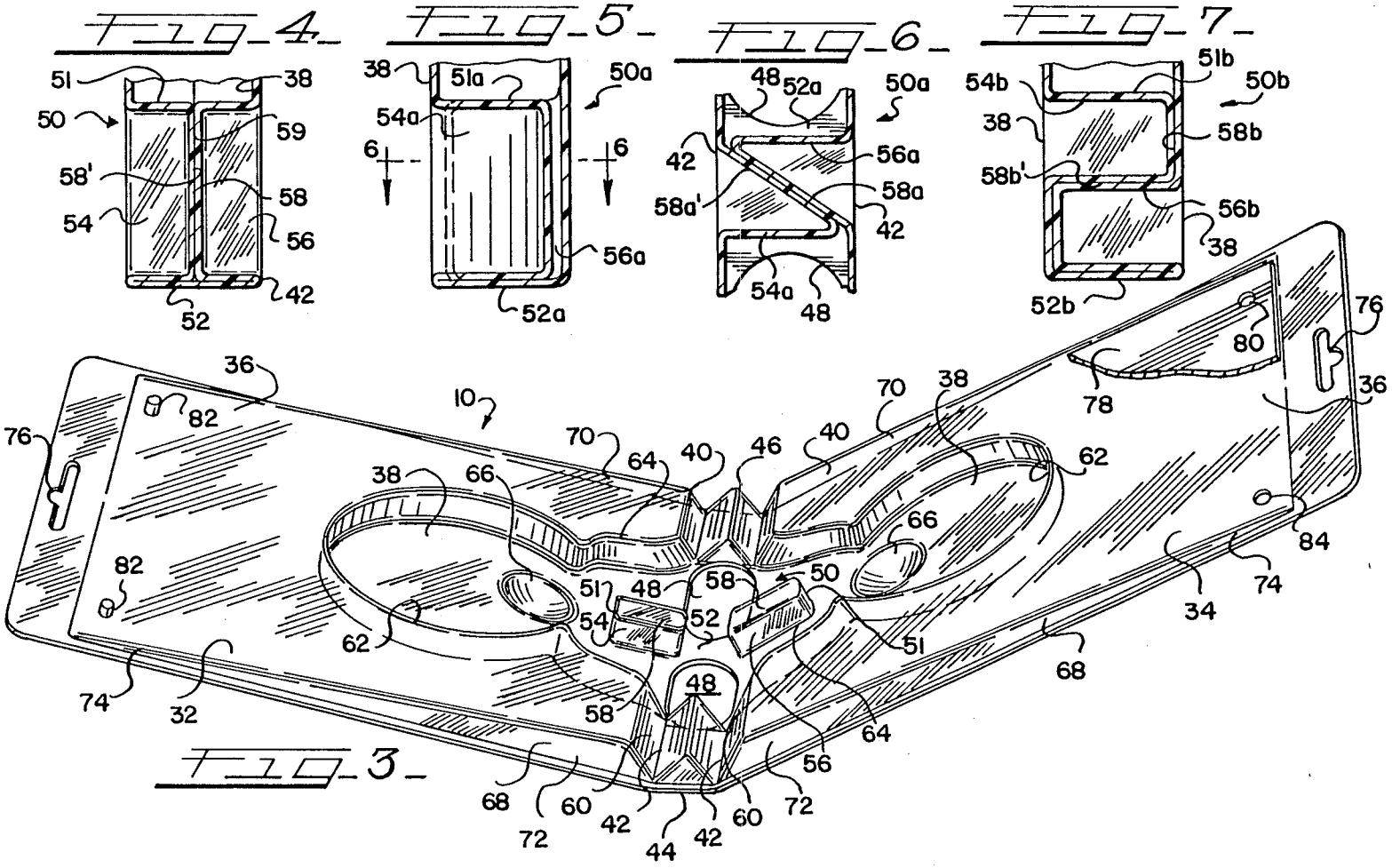
FIG. 3 is a side perspective elevational view of the package shown in FIG. 1 depicted in the open condition.
FIG. 4 is a vertical sectional view of the bridge formation taken along the line 4—4 of FIG. 1 and in the direction generally indicated.
FIG. 5 is a vertical sectional view of an alternate embodiment of the bridge formation of FIG. 4.
FIG. 6 is a sectional view taken along the line 6—6 of FIG. 5 and in the direction indicated generally.
FIG. 7 is a vertical sectional view of an alternate embodiment of the bridge formation of FIG. 4.

Referring now to FIGS. 3 and 4, the package 10 includes a pair of first and second panels 32 and 34, respectively, each panel 32, 34 having an upper or flanged end 36, a recess portion 38, and a lower end 40. The first and second panels 32 and 34 are substantially identical to each other and are disposed in opposing mirror image relationship to each other.

Each panel 32 and 34 is provided at its lower end 40 with a lower edge margin 42 which is integrally joined to a base portion 44. In the preferred embodiment, the first and second panels 32 and 34, and the base portion 44 are fabricated of one piece of transparent thermoformable sheet material such as PVC or equivalent material.

The package 10 is configured so that the lower edge margins 42 define fold lines making the package a so-called "tri-fold" blister package. The base portion 44 is strengthened by being provided with a ridge formation 46 along its longitudinal axis, the ridge formation defining a triangular configuration for the base portion 44. The base portion 44 is further provided with a pair of openings 48 which are preferably ellipsoid or elongate oval in shape and are spaced apart by the base 52 of a bridge formation, generally designated 50. The openings 48 are configured to accommodate at least restricted pivoting action of the handles 18 of the pliers 12. The bridge formation 50 is designed to project upwardly into the crotch 30 of the pliers 12 (best seen in FIG. 1) to support the pliers 12 within the package 10 upon a top surface 51.

The base 52 of the bridge formation 50 is generally planar and may be provided with folds (not shown) or other formations as are known in the field to provide plastic structures with additional strength. Further structural support is provided to the bridge formation 50 by a pair of bridge supports 54 and 56 located in each of the panels 32 and 34 respectively, in the recess area 38 thereof. Each bridge support 54, 56 is formed by creating an inwardly extending recess in the respective recess portion 38.

The supports 54 and 56 are configured so that when the package 10 is in the closed position (best seen in FIGS. 2 and 4), opposing faces 58 and 58' of the supports 54 and 56 tightly contact each form to form a reinforced structure to support the pliers in the package. To this end, the supports 54 and 56 may be provided in any one of a variety of configurations which form such a support structure. In the preferred embodiment, the supports 54 and 56 are generally rectangular and block-shaped, with opposing faces 58, 58' meeting along a vertical line 59 generally parallel with the panels 32 and 34.

Referring now to FIGS. 5 and 6, an alternate bridge configuration is shown, generally designated **50*a*, in which the supports 54*a* and 56*a* are generally wedge-shaped and meet along opposing vertical faces 58*a* and 58*a'* disposed at an angle relative to the panels 32 and 34. The base is designated 52*a* and the pliers rest upon the surface 51*a***.

Referring now to FIG. 7, another embodiment of the bridge formation is depicted, generally designated **50*b*. In this embodiment, the supports 54*b* and 56*b* are generally block-shaped, with one block disposed above the other. The base is designated 52*b*. Specifically, the support 54*b* is located above support 56*b*, and the supports 54*b* and 56*b* interface at the faces 58*b* and 58*b'*. In this embodiment, the pliers rest upon the surface 51*b*. Other equivalent geometrical configurations of the bridge formation 50** are contemplated.

When the package is in the closed position, with the pliers 12 partially enclosed therein (see FIGS. 1 and 2), the bridge supports 54 and 56 will contact each other along the faces 58, 58' to form a sufficiently strong "support" for the pliers 12 within the package 10 (best seen in FIG. 4). Additional strength is provided to the lower end 40 of the package 10 by the panels 32, 34, the angled sidewalls 60 of which also complement the wedge shaped ridge formation 46 of the base portion 44.

Each recess 38 has an ellipsoidal head portion 62 and a shoulder portion 64. In addition, each recess 38 is provided with an outwardly projecting dome or bubble shaped formation 66 which is disposed to be directly opposite the pivot point 24 of the pliers 12 when the pliers are secured within the package 10. The exact shape of the formation 66 is not critical, as long as a gap is formed between the package 10 and the pivot point 24 of the pliers to prevent any lubricant seeping from the pivot point from coming in contact with the surface of either panel 32 or panel 34 of the package 10. Such seepage in prior packages has been known to cause unsightly stains and/or smears on the transparent surface of the package, thereby obscuring the potential purchaser's view of the tool.

Referring now to FIGS. 2 and 3, each panel 32 and 34 is provided with a pair of side edge walls 68 and 70, each such wall being tapered in shape so that a lower portion 72 is relatively wider than a narrowed upper end 74. Such an edge wall configuration creates a tapered upper profile for the package 10 which enables extra packages to be displayed on the hooks of a point of purchase rack (not shown). The packages 10 are mounted on the display hooks by means of a die cut hang hole 76 located at the upper end 36 of each panel 32, 34.

In addition, a die cut information card 78 is provided, preferably having a shape which will allow it to be form fit around the recess 38 for visibility of the pliers 12 from either front or rear. The card 78 is provided with at least two openings 80 located in each corner thereof. The openings 80 are designed to permit contact between male and female cylindrical button fasteners 82, 84, respectively of the two panels 32 and 34, to allow for the sealing of the package 10 with the information card 78 and the pliers 12 sandwiched therebetween. The number and placement of the card openings 80 and the button fasteners 82 and 84 upon the panels 32 and 34 may vary with the particular application.

In operation, and referring to FIG. 1, the pliers 12 is positioned in the package 10 so that the handles 18 project through the opeings 48. The panels 32 and 34 are then joined together with the card 78 therebetween, and the unit 10 is sealed by engagement of the buttons 82 and 84 at the points of the opening 80 in the card. By enclosing the upper portion 20 of the pliers and providing an enlarged profile of the package 10, pilferage of the pliers is hindered.

When a prospective customer encounters a packaged pliers at the point of purchase, especially when that customer is a professional tradesman, the action of the pliers is critical in the decision of whether or not to purchase a certain brand. Thus, the customer should be able to manipulate the pliers in one hand to ascertain whether or not the pivoting action around the point 24 is smooth enough for the intended use. In addition, the customer may wish to see the manner in which the jaws 22*a* and/or 22*b* engage each other, and as such the customer may wish to grasp both handles and exert a squeezing pressure upon the pliers 12 to bring these jaws together.

Accordingly, the openings 48 and the elliptical head portions 62 and the shoulder portions 64 of the recess formations 38 are splayed to permit manipulation of the handles 18 and to accommodate the reciprocal spreading and retracting action of the pliers 12 indicated by the arrows 82. In the preferred embodiment, the configuration of the recesses 38 and the openings 48 are such that at least approximately ⅜ inch of reciprocal action of each of the handles 18 is permitted. In the event that the bridge formation 50 becomes compressed and/or distorted through squeezing the handles 18, the support of the pliers 12 will not be affected, and such compression will not impair the appearance of the package.

Thus, the working clamshell blister package of the invention provides an attractive presentation of pliers or other pivotal hand tools, wherein the front and rear portions are substantially visible through the transparent blister, and the handles are substantially free to be manipulated by the prospective purchaser at the point of sale. In addition, sufficient support is provided in the package to prevent the pliers from falling through the package even during such manipulation, and the upper portion of the tool is enclosed to prevent pilferage.

While a particular embodiment of the working clamshell blister package of the invention has been shown and described, it will be appreciated by those skilled in the art that changes and modifications may be made thereto without departing from the invention in its broader aspects and as set forth in the following claims.

I claim:

1. A working clamshell blister package for holding and displaying a pliers or similar hand tool having two pivoting members secured at a pivot junction, each such member having a handle at one end and a working portion at the other end, said package comprising:

a first panel having an upper end, a lower end and a recess formation;

a second panel having an upper end, a lower end and a recess formation, said second panel being a mirror image of said first panel;

said lower ends of said panel having portions being joined to form a hinged base portion, said base portion having a pair of openings with a bridge formation disposed therebetween, said openings being dimensioned to accommodate the handles of the tool therethrough and to allow for pivoting action thereof, said bridge formation being configured to support the pivot junction of the pliers;

said panels being configured so that when placed in contacting relation to each other, a compartment is formed therebetween by said recesses for accommodating the working portion of the pliers and allowing at least restricted pivoting action thereof.

2. The package as defined in claim 1 wherein each said recess is provided with an outwardly projecting bubble formation adjacent the pivot junctin of the pliers.

3. The package as defined in claim 1 wherein said recesses and openings are configured to permit approximately ⅜ inch left-to-right movement of the handles.

4. The package as defined in claim 1 wherein said recess formations each contain a bridge support portion of said bridge formation.

5. The package as defined in claim 4 wherein said bridge supports are block-shaped and interface along opposing vertical faces.

6. The package as defined in claim 4 wherein said bridge supports are wedge-shaped and interface along opposing angled vertical faces.

7. The package as defined in claim 4 wherein said bridge supports are block-shaped, with a first support disposed above a second support, said supports interfacing along opposing horizontal faces.

8. The package as defined in claim 1 wherein said first and second panels and said base portion are fabricated of a single sheet of polymeric material.

9. The package as defined in claim 8 wherein said sheet is transparent.

10. The package as defined in claim 1 wherein each said recess has a head portion and a shoulder portion.

11. The package as defined in claim 10 wherein said head portion is ellipsoid.

12. The package as defined in claim 1 wherein said panels are provided with side edge walls which are gradually narrowed towards said upper ends.

13. A combination tool and clamshell blister package therefor comprising:

a tool having two members joined in pivotal fashion at a junction, each said member having a handle at one end and a working portion at the other end;

a clamshell blister package including a sheet formed into first and second mirror-image panel, each panel having an upper end, a lower end and a recess;

portions of said lower ends being joined to form a base portion;

said base portion having a pair of openings separated by a bridge formation;

said recesses being disposed opposite each other to form a compartment therebetween when said panels are placed in contacting relationship, said compartment configured to enclose said working portion of said tool;

said package being configured so that when said tool is inserted therein, said handles extend through said openings, said junction is supported by said bridge formation, and upon manipulation of said handles, said working portion may be actuated within said compartment without opening said package.

14. The package as defined in claim 13 wherein each said recess is provided with an outwardly projecting formation adjacent the pivot junction of said tool.

15. The combination as defined in claim 13 wherein said package is configured to permit approximately ⅜ inch left-to-right movement of said handles.

16. The package as defined in claim 13 wherein said recess formations each contain a bridge support configured to engage said bridge formation of said base portion.

* * * * *

UNITED STATES PATENT AND TRADEMARK OFFICE

CERTIFICATE OF CORRECTION

PATENT NO. : 4,872,551

DATED : October 10, 1989

INVENTOR(S) : Brian S. Theros

It is certified that error appears in the above-identified patent and that said Letters Patent is hereby corrected as shown below:

On the cover page, the assignee should be indicated as --Klein Tools, Inc.--.

Column 1, line 14, after "of" insert --the--;

Column 1, line 53, change "of" to --for--;

Column 2, line 66, before "junction" insert --pivot--;

Column 3, line 9, after "portion" insert --or formation--;

Column 3, line 49, change "form" (first occurrence) to --other--;

Column 4, line 16, after "recess" insert --formation--;

Column 4, line 17, after "recess" insert --formation--;

Column 4, line 59, change "unit" to --package--;

Column 4, line 61, change "upper portion" to --head--;

Column 5, line 2, before "point" insert --pivot--;

Column 5, line 12, after "and" insert --the joined recessed formations form a compartment designed--;

UNITED STATES PATENT AND TRADEMARK OFFICE

CERTIFICATE OF CORRECTION

PATENT NO. : 4,872,551

DATED : October 10, 1989

INVENTOR(S) : Brian S. Theros

It is certified that error appears in the above-identified patent and that said Letters Patent is hereby corrected as shown below:

Column 5, line 17, change "handles" to --handle ends--;

Column 5, line 21, after "package" insert --10--;

Column 5, line 50, change "panel" to --panels--;

Column 6, line 1, change "junctin" to --junction--;

Column 6, line 55, change "package" to --combination--;

and

Column 6, line 61, change "package" to --combination--.

Signed and Sealed this

Twentieth Day of November, 1990

*Attest:*

*Attesting Officer*

HARRY F. MANBECK, JR.

*Commissioner of Patents and Trademarks*